United States Patent [19]

McKusick

[11] 4,193,072

[45] Mar. 11, 1980

[54] COMBINATION INFRARED RADIO FUZE

[75] Inventor: Wayne L. McKusick, Rochester, N.Y.

[73] Assignee: The United States of America as represented by the Secretary of the Navy, Washington, D.C.

[21] Appl. No.: 177,617

[22] Filed: Mar. 13, 1962

[51] Int. Cl.[2] ..... F42C 13/02; F42C 13/04; G01S 9/02

[52] U.S. Cl. ..... 343/6 ND; 102/213; 102/214; 343/7 PF

[58] Field of Search ..... 343/7, 6, 13.1, 6 ND, 343/7 PF; 102/70.2 P, 213, 214

[56] References Cited

U.S. PATENT DOCUMENTS

| | | | |
|---|---|---|---|
| 2,570,295 | 10/1951 | Vantine | 102/70.2 P |
| 2,882,823 | 4/1959 | Menke et al. | 102/70.2 P |
| 2,895,127 | 7/1959 | Padgett | 343/6 |
| 3,010,102 | 11/1961 | Ketchledge et al. | 343/6 |
| 3,046,892 | 7/1962 | Cosse et al. | 343/7 |

FOREIGN PATENT DOCUMENTS

| | | | |
|---|---|---|---|
| 552351 | 4/1943 | United Kingdom | 102/70.2 P |

*Primary Examiner*—Malcolm F. Hubler
*Attorney, Agent, or Firm*—R. S. Sciascia; A. L. Branning

EXEMPLARY CLAIM

2. A combination proximity fuze comprising a radio circuit and an infrared circuit, said radio circuit operative to produce a first voltage impulse when a reflected electromagnetic wave is received from a target, said infrared circuit operative to produce a second voltage impulse when a heat source from a target is detected, a first memory circuit connected to said radio circuit for storing said first voltage impulse for a first predetermined time interval, a second memory circuit connected to said infrared circuit for storing said second voltage impulse for a second predetermined time interval, a coincidence firing circuit connected to said first memory circuit and to said second memory circuit whereby a primer may be ignited when said first and second voltage pulses are applied to said coincidence firing circuit simultaneously within said first and second predetermined time intervals.

3 Claims, 1 Drawing Figure

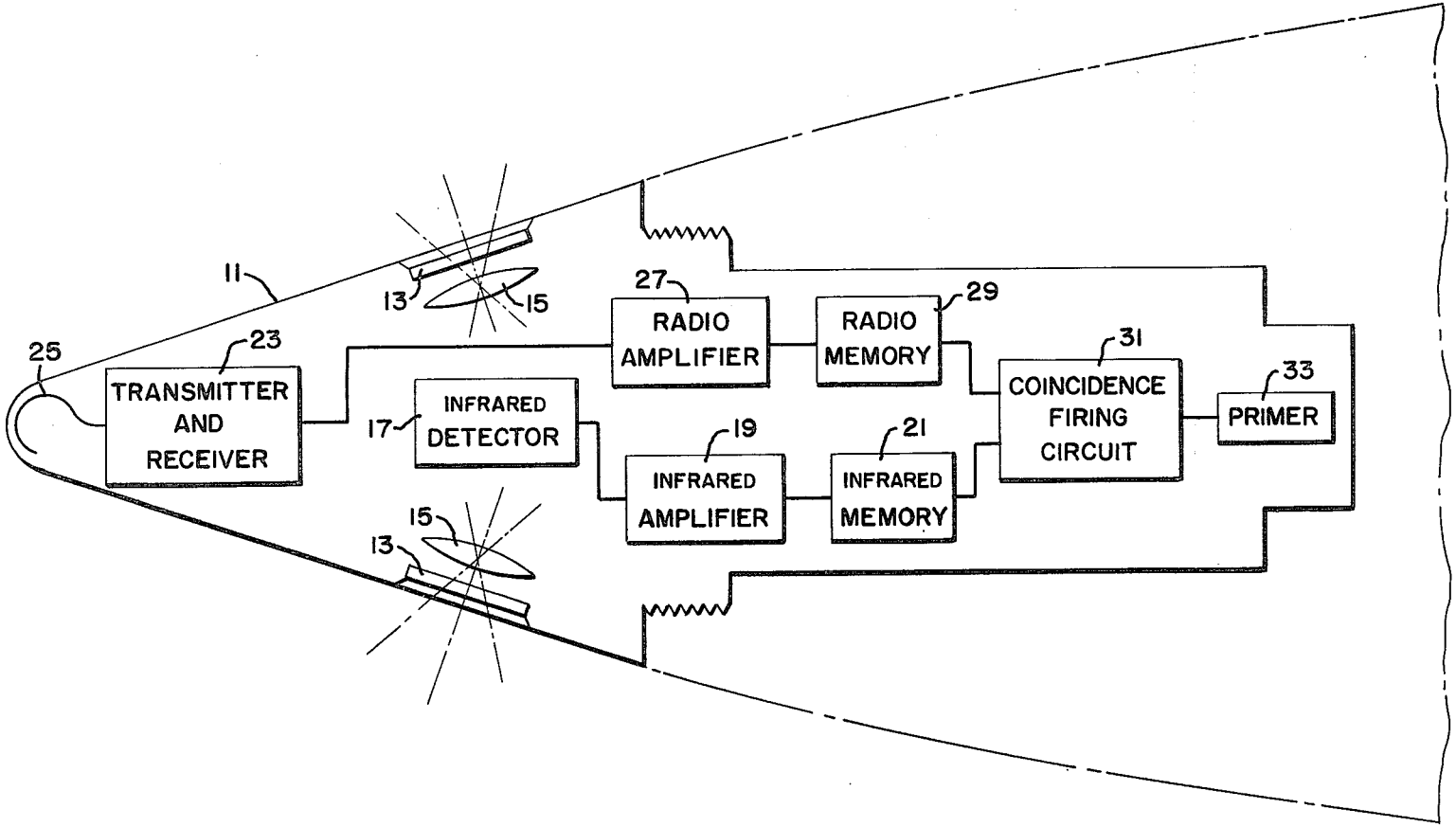
PRIMER
33
COINCIDENCE FIRING CIRCUIT
31
RADIO MEMORY
29
INFRARED MEMORY
21
RADIO AMPLIFIER
27
INFRARED AMPLIFIER
19
INFRARED DETECTOR
17
15
13
15
13
TRANSMITTER AND RECEIVER
23
11
25

COMBINATION INFRARED RADIO FUZE

This invention relates to a warhead fuze and more particularly to a combination of infrared and an electromagnetic VT fuze.

The electromagnetic VT or proximity fuze developed in past years is known to have operating deficiencies which make it less reliable than desired. For example, the radio doppler or proximity fuze is susceptible to countermeasures and has a reduced effectiveness when operating low over ocean waves. The electromagnetic VT fuze is also subject to enemy countermeasures, such as jamming for example, and natural causes of triggering such as snow, rain, water waves, terrain promontories and salvo effects.

By combining an infrared channel with a radio channel in a proximity fuze, the dependability and utility of the proximity fuze is increased considerably. With the dual channel system, the fuze may be triggered only if both the infrared and the radio channels are activated simultaneously. With the combination fuze, the probability of a premature explosion on the way to the target is greatly reduced. The radio section may be triggered by enemy jamming or natural causes mentioned above, while the infrared channel may be triggered by heat from the sun, bright clouds or other hot targets giving off infrared radiation. The probability that both radio and infrared channels will be prematurely triggered at the same instant is extremely small, however. Additionally, the combination fuze will serve as a counter countermeasure in the event that the radio channel is successfully jammed.

It is an object of this invention to provide a combination proximity fuze having a radio channel and an infrared channel.

It is another object of this invention to provide a combination radio infrared proximity fuze which will be activated upon simultaneous signals from the radio channel and the infrared channel of said fuze.

It is a further object of this invention to provide a counter countermeasure device comprising a combination proximity fuze having a radio channel and an infrared channel.

It is still another object of this invention to provide a combination radio and infrared proximity fuze operable only when the infrared and radio channels are activated simultaneously such that jamming is prevented.

It is a still further object of this invention to provide a double beam radio and infrared proximity fuze operable at relatively large miss distances.

Yet another object of this invention is to provide a double beam radio and infrared proximity fuze operable at relatively small distances from the surface of water waves.

Other objects and many of the attendant advantages of this invention will be readily appreciated as the same becomes better understood by reference to the following detailed description when considered in connection with the accompanying drawing wherein:

The single FIGURE of the drawing illustrates schematically a preferred embodiment of this invention.

Referring now to the drawing illustrating diagrammatically a preferred embodiment of this invention, a fuze housing 11 contains windows 13 for allowing infrared radiation to pass through lens 15 to the infrared detecting element 17. The output of the infrared detecting element 17 is connected to an infrared amplifier 19, the output of which is connected to an infrared memory circuit 21. The radio circuit includes a transmitter-receiver unit 23 and antenna 25. A radio amplifier 27 is connected to the output of transmitter-receiver unit 23 and to the input of radio memory unit 29. The outputs of infrared memory unit 21 and radio memory unit 29 are fed to the inputs of coincidence firing circuit 31. The output of coincidence firing circuit 31 may then be fed to primer 33.

In operation, radio transmitter-receiver unit 23 transmits and receives electromagnetic waves, the received electromagnetic waves being the returned transmitted electromagnetic waves which are reflected from the ground, water waves or targets, for example. The radio circuit is operated on the doppler principle. A desired reflected or received signal is picked up by antenna 25, detected in the receiver portion of transmitter-receiver unit 23 where the signal is detected and then passed to radio amplifier 27 for amplification. After amplification, the returned signal is fed into radio memory circuit 29 where it is stored or delayed for a period of 50 milliseconds, for example. The infrared circuit receives light waves including radiation in the infrared range of the light spectrum. Infrared radiation which enters windows 13 is concentrated or intensified upon infrared sensitive surfaces of infrared detector 17 by lenses 15. The radiation energy thus received is detected by infrared detector 17, converting the infrared energy into a d.c. voltage proportional to the intensity of the radiation received by detector 17. The voltage signal produced by detector 17 is amplified by infrared amplifier 19 and applied to infrared memory circuit 21 where the amplified d.c. signal is delayed or stored. When the radio signal and the received infrared radiation occur at the same time or within the delay period of the memory circuits, the voltages fed from the infrared memory circuit 21 and the radio memory circuit 29 will cause coincidence firing circuit 31 to conduct and complete an energizing circuit to primer 33.

If, for example, a target is sensed first by the infrared section and then by the radio section, as will be the case for far-out miss distances, the infrared memory circuit will act to maintain the firing level of one grid of a dual grid thyratron tube of the coincidence circuit for a time duration of 50 milliseconds, which time delay represents a time difference which may occur between the instant that the infrared fuze section senses a target and the instant that the radio section is triggered for targets that occur at far-out miss distances. For the targets which occur at near miss distances, the reverse is true, that is the radio section of the fuze will trigger first and the radio memory circuit will act to keep one grid of a dual grid thyratron at firing level for a period of 50 milliseconds during which delay time the infrared section of the fuze senses the target and places a firing level potential on the other grid of the thyratron, causing the thyratron to fire and actuate the primer circuit.

Obviously many modifications and variations of the present invention are possible in the light of the above teachings. It is therefore to be understood, that within the scope of the appended claims, the invention may be practiced otherwise than as specifically described.

What is claimed as new and desired to be secured by Letters Patent of the United States is:

1. A proximity fuze including a combination of a radio circuit and an infrared circuit, said infrared circuit including an infrared radition sensing means for sensing infrared radiation, infrared detector means connected to said sensing means for converting infrared radiation into an electrical signal, an amplifier connected to said detector for amplifying said signal, a memory circuit connected to said amplifier for holding said signal for a predetermined time period, means applying said signal to a first grid of a thyratron tube, said radio circuit comprising a transmitter for transmitting an electromagnetic signal, a receiver for receiving said transmitted electromagnetic signal reflected from a target, amplifier means connected to said receiver for amplifying the received electromagnetic signal, memory circuit means connected to said amplifier means for holding said electromagnetic signal for a predetermined time interval, means connected to said memory circuit means for applying said electromagnetic signal to a second grid on said thyratron tube, priming means, said thyratron tube having an ouput circuit connected to said priming means whereby said priming means may be detonated when voltages are applied to said first and second grids simultaneously.

2. A combination proximity fuze comprising a radio circuit and an infrared circuit, said radio circuit operative to produce a first voltage impulse when a reflected electromagnetic wave is received from a target, said infrared circuit operative to produce a second voltage impulse when a heat source from a target is detected, a first memory circuit connected to said radio circuit for storing said first voltage impulse for a first predetermined time interval, a second memory circuit connected to said infrared circuit for storing said second voltage impulse for a second predetermined time interval, a coincidence firing circuit connected to said first memory circuit and to said second memory circuit whereby a primer may be ignited when said first and second voltage pulses are applied to said coincidence firing circuit simultaneously within said first and second predetermined time intervals.

3. A combination infrared and radio doppler fuze in the nose of a missile comprising a radio circuit including a transmitter and a receiver, said transmitter operative to transmit electromagnetic wave signals to a target, said receiver operative to receive and detect said transmitted electromagnetic wave signals which are reflected from the target, a radio amplifier connected to said receiver for amplfiying the signals by said receiver, a radio memory circuit connected to said amplifier to hold each of said receiver signals for a desired time period, an infrared circuit including a plurality of windows in the shell of said nose, an infrared radiation detector disposed to detect infrared radiation received through said windows, lenses disposed between said windows and said detector to concentrate the infrared radiation upon said detector, said detector operable to convert infrared radiation into electrical voltage signals, an infrared amplifier connected to said detector to amplify said electrical voltage signals, an infrared memory circuit connected to said infrared amplifier and adapted to hold an electrical voltage signal from said amplifier for a desired time period, a coincidence firing device having a first input circuit, a second input circuit, and an output circuit, said output circuit connected to a primer and operative to energize said primer when a signal is applied to each of said first and second input circuits simultaneously, means connecting said radio memory circuit to said first input circuit of said coincidence device whereby a signal may be applied thereto, means connecting said infrared memory circuit to said second input circuit of said coincidence device whereby a signal may be applied thereto such that said primer will be energized when an electromagnetic wave and infrared radiation are received concurrently from a target.

* * * * *